United States Patent [19]

Wieffen

[11] 4,272,367

[45] Jun. 9, 1981

[54] STARTING TECHNIQUES FOR AN ELECTRO-PNEUMATICALLY ACTUATED WET SETTLING MACHINE

[75] Inventor: Karl-Heinz Wieffen, Bochum, Fed. Rep. of Germany

[73] Assignee: Klöckner-Humboldt-Deutz AG, Fed. Rep. of Germany

[21] Appl. No.: 35,703

[22] Filed: May 3, 1979

[30] Foreign Application Priority Data

May 26, 1978 [DE] Fed. Rep. of Germany ..... 2822975

[51] Int. Cl.[3] ..... B03B 5/20

[52] U.S. Cl. ..... 209/500; 364/502

[58] Field of Search ..... 209/1, 422, 455, 457, 209/488, 489, 497, 499, 500–502; 364/502, 420

[56] References Cited

FOREIGN PATENT DOCUMENTS 2411386 9/1975 Fed. Rep. of Germany ..... 209/500

2527756 1/1977 Fed. Rep. of Germany ..... 209/547

51312 7/1966 Poland ..... 209/502

OTHER PUBLICATIONS

"Electronisch Gesteuerte Setzmaschinenventile" Published by Wedag (4–1969).

*Primary Examiner*—Ralph J. Hill

*Attorney, Agent, or Firm*—Hill, Van Santen, Steadman, Chiara & Simpson

[57] ABSTRACT

An electropneumatically actuated wet settling machine for the separation of mineral mixtures, having a separating liquid to carry out a pulsating movement set in motion by the introduction of compressed air into exciter chambers via inlet and outlet valves, is controlled so that the start of the pulsation movement of separating liquid from a rest condition takes place through a gradual filling of the excitation chambers with compressed air, at least partially automatically controlled, and in particular by an electrical automatic starting control.

9 Claims, 1 Drawing Figure

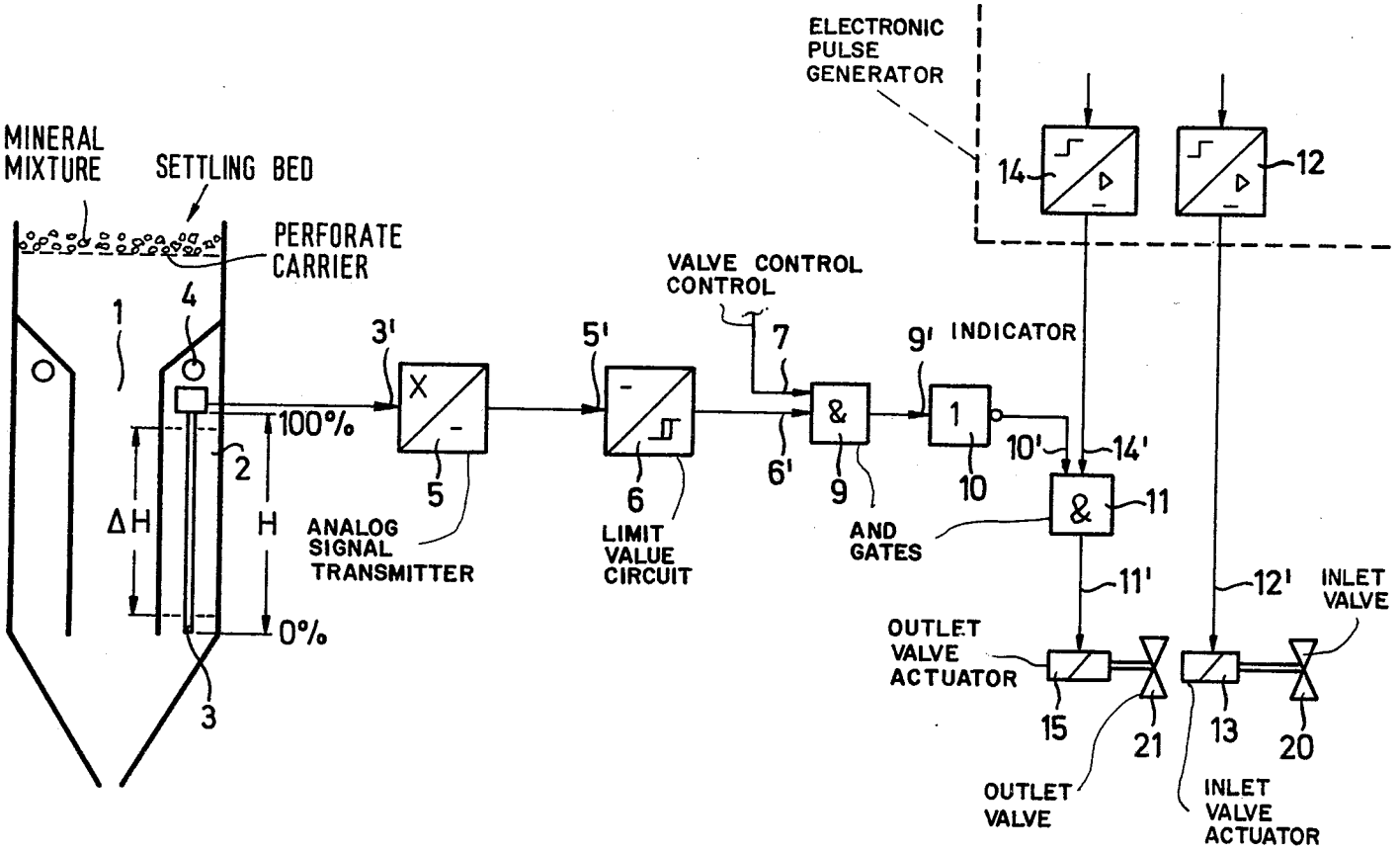
MINERAL MIXTURE
SETTLING BED
PERFORATE CARRIER
ANALOG SIGNAL TRANSMITTER
LIMIT VALUE CIRCUIT
VALVE CONTROL CONTROL
AND GATES
INDICATOR
ELECTRONIC PULSE GENERATOR
OUTLET VALVE ACTUATOR
OUTLET VALVE
INLET VALVE ACTUATOR
INLET VALVE
100%
0%
H
ΔH
1
2
3
4
5
5'
3'
6
6'
7
9
9'
10
10'
11
11'
12
12'
13
14
14'
15
20
21

STARTING TECHNIQUES FOR AN ELECTRO-PNEUMATICALLY ACTUATED WET SETTLING MACHINE

BACKGROUND OF THE INVENTION

1. Field of the Invention

The present invention relates to a method for starting an electropneumatically actuated wet settling machine for the separation of mineral mixtures, whose separating liquid carries out a pulsation movement which is set in motion by the introduction of compressed air into excitation chambers and exhaust of the air from the excitation chambers by way of inlet and outlet valves, respectively.

2. Description of the Prior Art

The starting of the pulsating movement of the separating liquid in wet settling machines heretofore occurred in practical operation such that air was admitted through the inlet valves and exhausted through the outlet valves, to and from the excitation chambers of the machine in correspondence with the rhythm or cycle of the settling movements. As is well known to those skilled in the art, the air displaces the water with amplitudes which slowly increase, the settling liquid, normally water, being located in the excitation chambers, and thus sets the pulsation movement in operation. Particularly with large machines, in which appreciable quantities of water are displaced and must be set in motion, the known starting operation, however, proceeds in an unsatisfactory manner in which starting takes too long, or particularly with a large quantity of material on the settling bed, the pulsation cannot be set in motion.

As is disclosed in the German published application 25 27 756.9, a starting method for wet settling machines is known in the art which ovecomes the foregoing defect. With this method, before the starting of the settling machine, the work chambers are first filled by means of control commands of the operators, first with displacement air of constant pressure, which presses the water out of the displacement chambers. The displacement air is then released through the outlet valves from the excitation chambers, and thus initiates a first downward stroke of the machine, with which the normal pulsation movement may be initiated. As a rule, this method operates satisfactorily with sufficient attention of the operators. It is unsatisfactory that, by means of a special control command, the filling of the excitation chambers with air must precede the actual starting operation, and that each settling chamber must be provided with an air feed having a control valve.

SUMMARY OF THE INVENTION

It is therefore the object of the present invention to provide a starting method for wet settling machines which, without further increase in the structural expense, avoids the starting difficulties resulting particularly upon operation of large settling machines, and which permits the starting operation to take place reliably and without difficulty. An attendant object is to make this starting operation automatic.

The above object is achieved in that the start of the pulsating movement of the separating liquid from a rest position, at least partially automatically controlled, takes place through a step-wise filling of the excitation chambers with compressed air, particularly by means of an electrically operating automatic starting control.

Through this embodiment of the starting method, it is advantageously attained, that the starting operation of the settling machine can always proceed in the same manner, without requiring structural expense for the machine. In this manner, the entire operation of the wet settling machine will be appreciably improved in a practical operation; errors in servicing upon starting have been obviated.

In one embodiment of the invention, it is provided that first the control is connected for the inlet and outlet valves, particularly an electric pulse control. Through the switching on of the control for the inlet and outlet valves, it is ensured that with the beginning of the starting operation, the machine is actually ready for operation and may assume the provided pulsation directly after starting. Furthermore, the prerequisites are therefore furnished for the progress of the step-filling operation.

In a further development of the invention, it is provided that subsequently to the switching on of the control, the movement of the inlet valves is released corresponding with the control. It is therefore attained that the air present in front of the inlet valve reaches, in the cycle of the inlet valve, into the excitation chamber and little by little fills the excitation chamber in steps corresponding to the quantity of air supplied in each case. Therefore, it is advantageously possible, without an additional control element or valve to fill the same automatically through the normal air conduit of the excitation chambers.

In a further development of the invention, it is provided that after a time determined in advance, particularly through a timing device, the movement of the outlet valve is released corresponding to the control. Through the timing device, the time is adjusted which is necessary for the filling of the excitation chambers with air. The latter can be calculated in advance or determined by means of simple tests. In this manner, simply a complete filling of the excitation chambers is attained and the outlet valve is released, which leads to a breakthrough of the air on the lower excitation chamber wall. The utilization of a timing device, in a similar manner, also a valve-actuating meter device may be interpolated; this is especially advantageous with settling machines which do not have an indicating apparatus in the excitation chamber.

In another development of the starting method of the present invention, it is provided that the movement of the separating liquid in the pulsation chambers is measured, advantageously, by means of an analog system, and the measuring value is supplied to a limit value switch, whereby the signal of the measured value, after achieving a preadjusted magnitude of the measured value, causes the movement of the outlet valves corresponding to the control pulse. Through this construction, the reliability of the starting procedure is further improved. Independently of pre-indicated and eventual changes or disturbances of dimensions not becoming satisfactory, air is supplied to the excitation chamber step-wise for so long until the driving filling is attained. Subsequently, automatically the movement of the outlet valves begins. The starting operation progresses, therefore, reliably free from difficulty. Fluctuations in the outer air pressure, the air pressure of the air occurring in front of the excitation chambers, etc. are automatically compensated and take effect just as little as an increase load of the settling bed on the starting operation.

In a further development of the invention, it is provided that the magnitude of the analog signal is optically indicated by an indicator device. With this construction, it is simply and easily possible for the servicing personnel to supervise the automatic progress of the starting operation and to control the filling of air, in accordance with the present invention, of the excitation chambers.

Advantageously, in this connection the indicating system which later indicates the pulsating movement of the air in the excitation chambers may be used. For the signal, as a rule, an analog indicator is selected; a digital indicator is, however, likewise suitable for utilization.

The starting method according to the present invention will be explained in greater detail on the basis of a circuit diagram from which further details are to be derived.

BRIEF DESCRIPTION OF THE DRAWING

Other objects, features and advantages of the invention, its organization, construction and operation will be best understood from the following detailed description, taken in conjunction with the accompanying drawing, on which there is a single FIGURE which illustrates, in a schematic form, a preferred embodiment of the invention.

DESCRIPTION OF THE PREFERRED EMBODIMENTS

Referring to the drawing, a circuit diagram is illustrated showing a cross-sectional view taken through a portion of a settling bed. In this connection, an unpulsed settling machine, as is shown and described, for example, in the "Mining Congress Journal", May 1974, pp. 43–49, the American Mining Congress, Washington, D.C., under the title "Batac-Jig".

In the settling bed portion 1 is arranged an excitation chamber 2, a measuring test probe 3, which is advantageously constructed as a capacitively operating measuring or test probe corresponding to the "Silometer" of the firm Endress & Hauser GmbH & Co., Germany, described in the periodical FMC 280. Above the probe 3, the air inlets or outlets 4 are illustrated, in the upper portion of the excitation chambers 2, which are correlated with the air inlet and outlet valves, not shown.

The circuit of the starting method operates as follows.

The probe 3 emits a signal 3' to a transmitter 5, which supplies the signal 5' to the value limit transmitter 6, which resupplies the same as a starting signal 6'. The type of conversion for the limit value transmitter 6, responds, in this connection, to the symbols illustrated in the transmitter 6.

There is provided by the limit value transmitter 6, upon achieving the previously adjusted limit value, a signal 6' which, together with a signal 7 of the valve control, which occur when the latter is turned on, is supplied to an AND gate 9. The AND gate 9, when the prerequisite "AND" function is present, transmits a control signal 9' through an indicating device 10 in the form of a signal 10' to an AND gate 11. As a previously set limit value, advantageously a value from the range of 70–95% of the excitation chamber height is adjusted, particularly the value 80%. In the diagrammatic illustration of the drawing, this value is designated as ΔH.

The AND gate 11, upon occurrence of the signals 10' and 14', emits the opening signal 11' for the outlet valve 21, the signal 14' being derived from the valve control circuit portion 14 for switching on of the valve control of the outlet valve 21, the opening signal 11' actuating the valve 21 by way of an electromagnetic valve actuator 15. The valve control device 14 is, in this connection, just as the control device 12 for the inlet valve, constructed of integrated circuit metal-oxide-semiconductor (IC-MOS) building blocks, which are preferably arranged on relay insert cards. Corresponding building blocks, control elements and the like are known to those skilled in the art from technical bulletins of, for example, Siemens AG, Valvo and Texas Instruments. The control of the inlet valve 20, and therewith the beginning of the starting operation, takes place independently of the control of the outlet valve 21 by means of the signal 12', which may be transmitted after switching on of the valve control, and likewise acts through an electromagnetic device 13 on the inlet valve 20.

The starting operation proceeds accordingly in such a manner that first the valve control 12, 14 is switched on. The pulses 14' and 12' are provided once to the AND gate 11 and once to the inlet valve apparatus 13, 20. Through the AND gate 11, first the outlet valve 21 is blocked, and the AND function is not yet fulfilled. Accordingly, first the inlet valve begins to operate according to the pre-programmed valve control 12, 14. After the preadjusted height ΔH is attained in the excitation chamber, and the AND condition is fulfilled in the AND gate 11, the outlet valve begins to work as pre-programmed. Now the starting operation is ended and the settling machine operates with the pulsation magnitude and frequency determined in advance. It should be noted that, because of the AND function provided by the AND gate 11, any number of signals 14' may be applied toward the outlet valve 21 without effecting operation of the valve until such time as the signal 10' is provided, as will result from the proper height being reached and indicated through the elements 5, 6, 9 and 10.

The starting method according to the present invention is not only utilized both with settling machines of the Batac type, as such machines are described in the Mining Congress Journal. It may just as well be utilized with electromagnetically controlled settling machines of the Baum type or other types of settling machines, such as round settling machines, etc. Also the presence of an electromagnetic control is not necessary, as particularly the construction having a valve actuating meter or a timing member for embodiments with rotary slide valves, etc, is suitable. Common to all embodiments is the fact that first the outlet valves and also their collecting pipe remains blocked and that therefore the starting postion for the pulsation is attained gradually, whereby the starting operation takes place at least partially automatically. In all cases, the starting operation is decisively improved and shortened, so that especially with short periods of standstill, a rapid reliable restarting is possible after overcoming the disturbance.

Although I have described my invention by reference to certain illustrative embodiments thereof, many changes and modifications of the invention may become apparent to those skilled in the art without departing from the spirit and scope of the invention. I therefore intend to include within the patent warranted hereon, all such changes and modifications as may reasonably and properly be included within the scope of my contribution to the art.

I claim:

1. In a starting method for a wet settling machine for separating mineral mixtures in which a separating liquid is excited into pulsations through the introduction of air into and the exhausting of air from excitation chambers via respective air inlet and outlet valves, and in which the excitation chambers are gradually filled with compressed air to a predetermined level, the improvement comprising the steps of:

sensing the filling of the excitation chambers with air by electrically sensing the liquid level in the excitation chambers and producing a corresponding first electrical signal;

measuring the first electrical signal with respect to a limit value;

producing a second electrical signal in response to the first electrical signal exceeding the limit value;

combining the second electrical signal with a third signal which indicates valve operation possibility to provide a fourth electrical signal;

producing a fifth electrical signal in response to the fourth electrical signal;

generating a sixth electrical signal as a command to open the outlet valve;

combining the fifth and sixth signals to produce a valve open signal;

applying the valve open signal to a valve actuator for opening the outlet valve; and thereafter automatically operating the inlet and outlet valves in a predetermined cyclic sequence after sensing the predetermined level and initially opening the outlet valve.

2. The improved method of claim 1, further comprising the step of applying the fourth signal to operate an indicating device to indicate that the outlet valve may be opened.

3. Apparatus for starting operation of a wet settling machine which has a bed for supporting mineral mixture in a settling chamber which contains a separating liquid, an excitation chamber in the settling chamber, an air inlet valve connecting the excitation chamber to a supply of compressed air, and an air outlet valve for exhausting air from the excitation chamber, said apparatus comprising:

first signal means connected to the air inlet valve and operable to provide a first signal to open the inlet valve and permit gradual filling of the exhaust chamber with air;

second signal means connected to the air outlet valve and operable to provide a second signal as a command to open the air outlet valve; and third signal means, including a sensor in the settling chamber, connected between said second signal means and the air outlet valve and operable to block said second signal from causing opening of the outlet valve until said sensor senses a predetermined liquid level in said settling chamber, said third signal means including signal transmitter means connected to said sensor and operable on an analog basis to provide a third signal indicating liquid level, limit value means connected to said signal transmitter means and operable to produce a fourth signal in response to said third signal exceeding a predetermined limit value, and gating means connected to said limit value means, to said second signal means, and to the air outlet valve and responsive to said second and fourth signals to cause opening of the air outlet valve.

4. The apparatus of claim 3, wherein said first signal means comprises a pulse generator.

5. The apparatus of claim 3, wherein said second means comprises a pulse generator.

6. The apparatus of claim 3, comprising:

a valve control including said first and second signal means and a fourth signal means for producing a fifth signal to indicate to the apparatus that it is possible to operate the air outlet valve;

and wherein said gating means comprises a first AND gate connected to receive said fourth and fifth signals.

an indicator connected to and operated by said first AND gate, and a second AND gate connected to said first AND gate via said indicator and connected to said second signal means and operated in response to said second, fourth and fifth signals, said second AND gate connected to and controlling the operation of the air outlet valve.

7. The apparatus of claim 3, wherein the outlet valve is a rotary slide valve, and said apparatus comprises:

a timing circuit in said third signal means and connected to control the rotary slide valve.

8. The apparatus of claim 3, wherein the outlet valve is an electromagnetically-controlled valve, and said apparatus comprises:

an electromagnetic valve actuator in said third signal means connected to the outlet valve.

9. Apparatus for starting operation of a wet settling machine which has a bed for supporting a mineral mixture in a settling chamber which contains a separating liquid, an excitation chamber in the settling chamber, an air inlet valve connecting the excitation chamber to a supply of compressed air, and an air outlet valve for exhausting air from the excitation chamber, said apparatus comprising:

pulse generating means including first and second outputs and operable to provide cyclic pulses alternately at said first and second outputs, said first output connected to the inlet valve to cyclically open the inlet valve and cause a gradual step-wise filling of the excitation chamber with compressed air;

a sensor in the excitation chamber for sensing and providing a level signal indicating the level of the separating liquid;

circuit means connected to said sensor and operable to provide a control signal in response to the level signal exceeding a predetermined magnitude; and gate means connected to said circuit means and to said second output and to the outlet valve for opening the outlet valve in response to the conjunct occurrence of a pulse and a control signal.

* * * * *